US009409631B2

(12) United States Patent
HØvik et al.

(10) Patent No.: US 9,409,631 B2
(45) Date of Patent: Aug. 9, 2016

(54) LOADING HOSE

(75) Inventors: Jon HØvik, Færvik (NO); Rients van der Woude, Risor (NO)

(73) Assignee: MacGregor Norway AS, Kristiansand (NO)

( * ) Notice: Subject to any disclaimer, the term of this patent is extended or adjusted under 35 U.S.C. 154(b) by 138 days.

(21) Appl. No.: 13/820,376

(22) PCT Filed: Aug. 29, 2011

(86) PCT No.: PCT/EP2011/064775
§ 371 (c)(1),
(2), (4) Date: Apr. 18, 2013

(87) PCT Pub. No.: WO2012/028561
PCT Pub. Date: Mar. 8, 2012

(65) Prior Publication Data

US 2013/0203311 A1 Aug. 8, 2013

(30) Foreign Application Priority Data

Sep. 1, 2010 (NO) ..... 20101216

(51) Int. Cl.
*B63B 22/00* (2006.01)
*B63B 27/24* (2006.01)
*B67D 9/00* (2010.01)

(52) U.S. Cl.
CPC .. *B63B 27/24* (2013.01); *B67D 9/00* (2013.01)

(58) Field of Classification Search
CPC ..... B63B 27/24; B63B 27/34; B63B 27/25; B67D 9/00
USPC ..... 441/133, 3, 4, 5; 114/230.1, 230.12, 114/230.13, 230.2, 230.23; 405/169, 171, 405/195.1, 207, 208, 210, 224.2
See application file for complete search history.

(56) References Cited

U.S. PATENT DOCUMENTS

| | | | | |
|---|---|---|---|---|
| 3,466,680 | A | 9/1969 | Schirtzinger | |
| 5,431,589 | A * | 7/1995 | Corona | 441/4 |
| 5,582,252 | A * | 12/1996 | Richmond et al. | 166/352 |
| 5,803,779 | A | 9/1998 | Horton, III | |
| 6,916,218 | B2 * | 7/2005 | Lavagna et al. | 441/4 |
| 7,677,837 | B2 | 3/2010 | Pionetti et al. | |
| 2007/0009329 | A1 | 1/2007 | Chouest | |
| 2007/0059104 | A1 * | 3/2007 | Clausen et al. | 405/171 |
| 2010/0055363 | A1 * | 3/2010 | Chevalier et al. | 428/36.5 |
| 2010/0101473 | A1 * | 4/2010 | Breivik et al. | 114/230.23 |

FOREIGN PATENT DOCUMENTS

| | | | |
|---|---|---|---|
| EP | 0 396 391 | A1 | 11/1990 |
| EP | 1 428 748 | A1 | 6/2004 |

(Continued)

OTHER PUBLICATIONS

International Search Report issued in PCT/EP2011/064775 mailed Dec. 7, 2011 (4 pages).
Written Opinion issued in PCT/EP2011/064775 mailed Dec. 7, 2011 (4 pages).
International Preliminary Report on Patentability w/amended sheets issued in PCT/EP2011/064775 mailed Oct. 30, 2012 (11 pages).
Norwegian Search Report issued in U.S. Pat. No. 20101216 dated Feb. 21, 2011 (2 pages).

(Continued)

*Primary Examiner* — Anthony Wiest
(74) *Attorney, Agent, or Firm* — Osha Liang LLP

(57) ABSTRACT

A hydrocarbon loading hose (4) for connection between a GBS (1) and a shuttle hydrocarbon transport vessel (2), arranged in water (W) and at a distance apart, comprises buoyancy means (5) in its mid region and at least one buoyancy element (7*a, b*) in a free end region.

5 Claims, 3 Drawing Sheets

(56) References Cited

FOREIGN PATENT DOCUMENTS

| | | | |
|---|---|---|---|
| GB | 2 390 351 | A | 1/2004 |
| WO | 02/08116 | A1 | 1/2002 |
| WO | 02/060750 | A1 | 8/2002 |
| WO | 2005/090152 | A1 | 9/2005 |
| WO | 2005/108200 | A1 | 11/2005 |
| WO | 2006/120351 | A1 | 11/2006 |
| WO | 2009/095401 | A2 | 8/2009 |

OTHER PUBLICATIONS

Decision on Granting a Patent for Invention in corresponding Russian Patent Application No. 2013109178/11 (013628) (4 pages).
Abstract of Invention in Russian Patent Application No. 2162044 (1 pages).
Abstract of Invention in Russian Patent Application No. 2246443(1 pages).

* cited by examiner

LOADING HOSE

CROSS-REFERENCE TO RELATED APPLICATIONS

This application is a national stage application of PCT/EP2011/064775, filed on Aug. 29, 2011, entitled "A LOADING HOSE," which claims priority to Norwegian Patent Application No. 20101216, filed on Sep. 1, 2010. Each of these priority applications are incorporated herein by reference in their entireties.

FIELD OF THE PRESENT DISCLOSURE

This present disclosure relates generally to an offshore loading system such as a shuttle tanker or the like and a product transfer system for transferring hydrocarbon products via an associated product flowline arrangement between a production and/or storage facility and the shuttle tanker.

BACKGROUND OF THE PRESENT DISCLOSURE

In deep water operations, certain operational considerations make it desirable to offload hydrocarbons from a production and/or storage facility by running a pipeline to an offshore loading system such as a shuttle tanker, either directly or via a so-called CALM buoy (CALM=Catenary Anchored Leg Mooring). Deep water installations, e. g., in depths greater than about 300 meters, require that the pipeline be suspended between the production and/or storage facilities and the shuttle tanker, rather than running the pipeline along the sea bed.

The state of the art includes WO 0208116 A1, which describes a system for transferring a load from ship-based production and storage units to dynamically positioned shuttle tankers. The system comprises a loading hose which, during a loading operation, extends between an end of the ship-based unit and a bow manifold on the tanker, and which is stored on the ship-based unit when not in use.

When the tanker is loading, the loading hose hangs in a catenary configuration between the vessel and the manifold on the tanker. In such related art systems, the separation (distance) between the tanker and the vessel is typically about 80 meters.

It is presently a desire by ship owners and operators to increase the separation between the hydrocarbon storage facility and the shuttle tanker considerably, primarily due to safety considerations and operational flexibility. Separation distances of about 250 to 300 meters are being discussed. Such increased separation distances will increase the weight of the hose and require a reinforced pull-in and connection equipment aboard the tanker, in order to handle the loads imposed by the loading hose catenary.

SUMMARY OF THE PRESENT DISCLOSURE

The present disclosure is set forth and characterized in the main claims, while the dependent claims describe other characteristics of the present disclosure.

It is thus provided a fluid transfer system, comprising a first structure and a second structure arranged in water and at a distance apart, and a pipeline configured for connection between the structures, characterized in that the structures comprise respective means for suspending respective ends of the pipeline, and in that the pipeline comprises buoyancy means in its mid region and at least one buoyancy element in an end region.

In one embodiment, the means for suspending the pipeline on the first structure comprises a reel, onto which the pipeline may be stored.

In one embodiment, the pipeline comprises a free end with a coupling for connection to coupling and suspension means on the second structure, and the at least one buoyancy element is connected to the pipeline in a region of the free end and in the vicinity of the coupling, whereby the pipeline free end is capable of floating in or near the water surface.

In one or more embodiments, the buoyancy elements and buoyancy means may be arranged around a respective portion of the pipeline and are shaped such that the pipeline may be reeled onto the reel without a need for removing the buoyancy elements or buoyancy means.

In one embodiment, the buoyancy elements and buoyancy means comprise a compartment into which a ballast material may be inserted.

In one embodiment, the first structure comprises a hydrocarbon production and/or storage facility resting on a seabed, and the second structure comprises a shuttle tanker. The coupling and suspension means is in one embodiment arranged in a bow region of the shuttle tanker.

In one embodiment, the buoyancy means are configured with a buoyancy of such magnitude in relation to the weight of the pipeline which it is supporting, that the hose mid region is submerged when the hose is in the water.

It is also provided a hydrocarbon loading hose for connection between a hydrocarbon production and/or storage facility and a hydrocarbon transport vessel, said storage facility and transport vessel being arranged in water and at a distance apart, characterized by buoyancy means in its mid region and at least one buoyancy element in an end region.

In one embodiment, the loading hose comprises a free end with a coupling for connection to coupling and suspension means on the transport vessel, and the at least one buoyancy element is connected to the loading hose in a region of the free end and in the vicinity of the coupling, whereby the free end is capable of floating in or near the water surface.

The device according to the present disclosure enables the use of standard shuttle tankers even as the distance between the vessels is increased, from today's approximately 80 meters to distances as much as 250 to 300 meters. There is thus no need to reinforce the pull-in and connection equipment on the shuttle tanker, which would have been necessary with the related art catenary configuration. Also, in the case of an emergency situation where the loading hose has to be quickly disconnected from the shuttle tanker, the hose coupling (the hose free end) will float in or near the water surface, from where it may be easily retrieved.

The present disclosure is of particular use in offshore conditions, where higher sea-states (e.g. significant wave height, $H_s$ exceeding 3 m) prohibits the use of an all-buoyant loading hose, i.e. a hose which is floating in the water surface.

The invented pipeline will, when it is suspended by both ends from the tanker and the storage facility, respectively, be submerged in the water but exhibit a W-shape in the water, due to the midsection buoyancy means. When the pipeline end is released from the tanker, the buoyancy elements at the free end will prevent the free end from sinking down into the water.

BRIEF DESCRIPTION OF THE PRESENT DISCLOSURE

These and other characteristics of the present disclosure will be clear from the following description of the one or more embodiments, given as a non-restrictive example, with reference to the attached schematic drawings wherein.

DETAILED DESCRIPTION OF THE PRESENT DISCLOSURE

Figure 1:
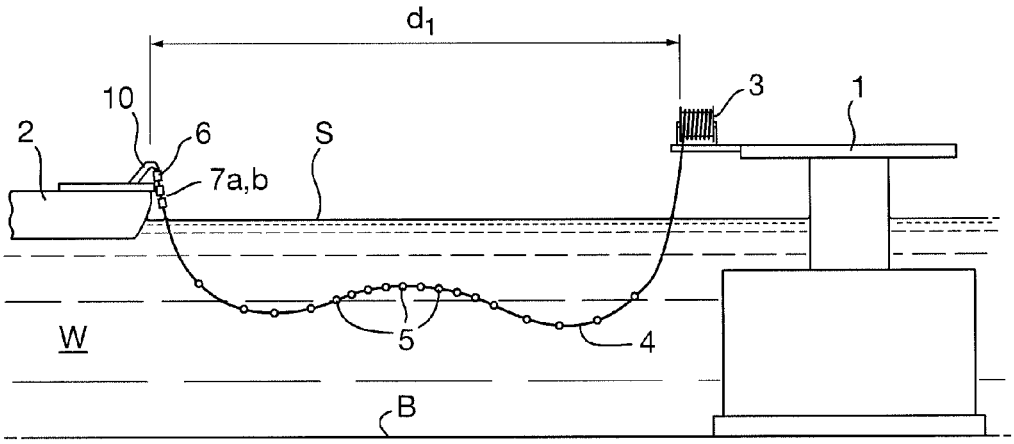
FIG. 1 is a side view of an embodiment of the system according to the present disclosure, showing the loading hose suspended between a shuttle tanker and a storage facility being a nominal distance apart.

FIG. 1 illustrates a hydrocarbon production and/or storage facility 1 (e.g. a gravity base structure; GBS) resting on a seabed B below a body of water W. The GBS 1 is equipped with a storage reel 3 for the hose 4, in a manner which is known in the art. The hose 4 is hence suspended from the reel 3, extends down into the water, and runs in a submerged state to a shuttle tanker 2 where the hose end via its associated coupling 6 is suspended to and fluidly connected to coupling and suspension means 10 in the bow area of the shuttle tanker 2. The shuttle tanker may be moored to the seabed or may utilize dynamic positioning equipment. In FIG. 1, the shuttle tanker 2 is positioned at a nominal distance $d_1$ (of e.g. 250 meters) from the GBS 1.

A number of buoyancy elements 5 are arranged in the mid section of the hose 4, causing the hose mid section to curve upwards towards the water surface, thus forming a "soft W" or a "soft catenary" in the water. The net buoyancy is such that the hose mid section remains below the water surface. FIG. 1 illustrates how buoyancy elements 5 may be distributed on the hose in order to achieve the "soft W" shape. The majority of the buoyancy elements 5 are located around the hose mid section, providing the greater buoyancy in this section, while fewer buoyancy elements are attached to either side of the mid section, providing less buoyancy in these sections. With the exception of the buoyancy element(s) connected to the hose free end (described below), no buoyancy elements are connected to the portions of the hose extending up to the shuttle tanker and GBS. The hose 4 in FIG. 1 therefore comprises a buoyant mid section, intermediate sections of lesser buoyancy, and end sections of no buoyancy.

One or more buoyancy elements 7*a,b* are connected to the hose at a region near the hose coupling 6.

Figure 2:
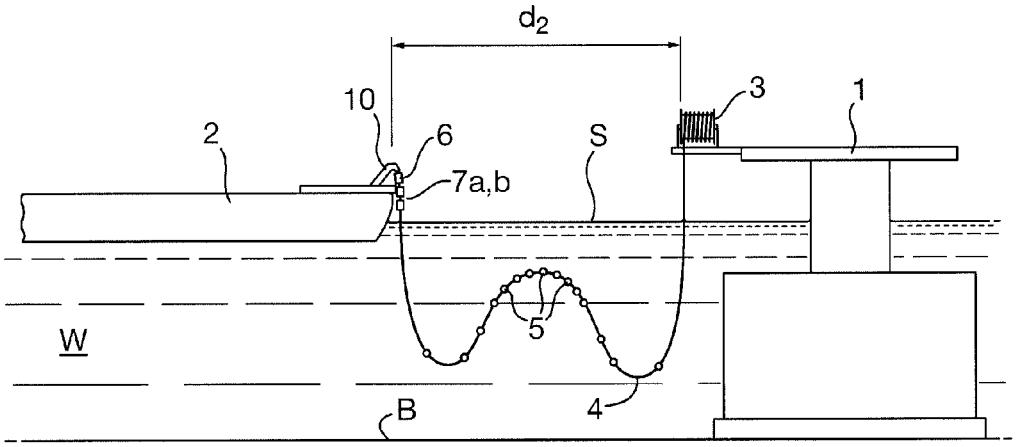
FIG. 2 is a side view similar to that of FIG. 1, but where the separation distance is less than nominal distance.

FIG. 2 shows the same system as FIG. 1, but illustrates how the hose behaves in the water when the shuttle tanker 2 is moved closer to the GBS than in FIG. 1, e.g. to a less than nominal distance $d_2$ (of e.g. 150 meters) from the GBS 1.

Figure 3:
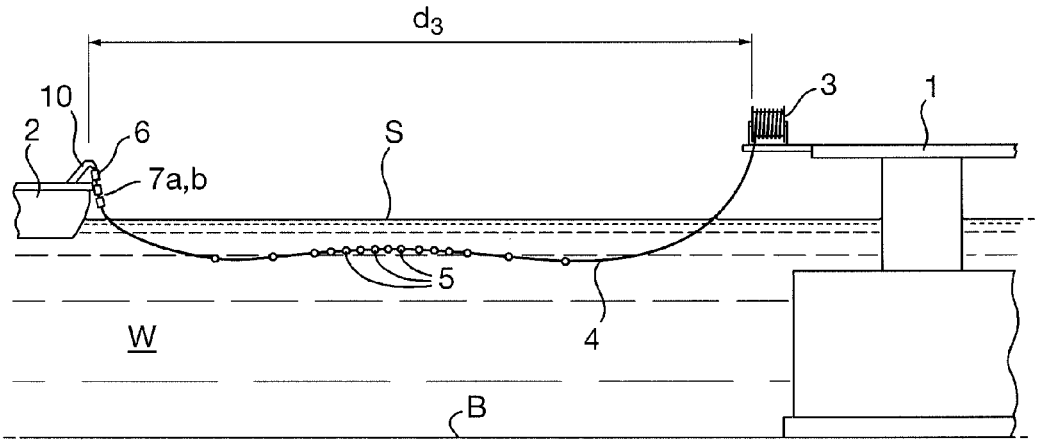
FIG. 3 is a side view similar to that of FIG. 1, but where the separation distance is greater than nominal distance.

FIG. 3 shows the same system as FIG. 1, but illustrates how the hose behaves in the water when the shuttle tanker 2 is moved farther away from the GBS than in FIG. 1, e.g. to a greater than nominal distance $d_3$ (of e.g. 310 meters) from the GBS 1. In all of these states (FIGS. 1, 2, 3) the hose is not floating in or near the water surface.

When a shuttle tanker 4 is moving into position in order to load hydrocarbons from the GBS, the shuttle tanker is manoeuvred into a so-called pick up zone, and a pneumatic line thrower (not shown) shoots a line over to the shuttle tanker. This line is connected to the hose rope on the reel and to the messenger line winch on the shuttle tanker. The hose 4 rope is then paid out by rotating the reel 3 on the GBS, and the coupling 6 is pulled into and connected to the coupling station 10 on the tanker. In this state (cf. FIG. 1), the loading process may commence. When loading has been completed, the procedure is reversed, i.e. the hose is reeled back onto the reel 3. The buoyancy elements 5, 7*a,b* are shaped and configured such that they may remain on the hose even when the hose is stored on the reel.

Figure 4:
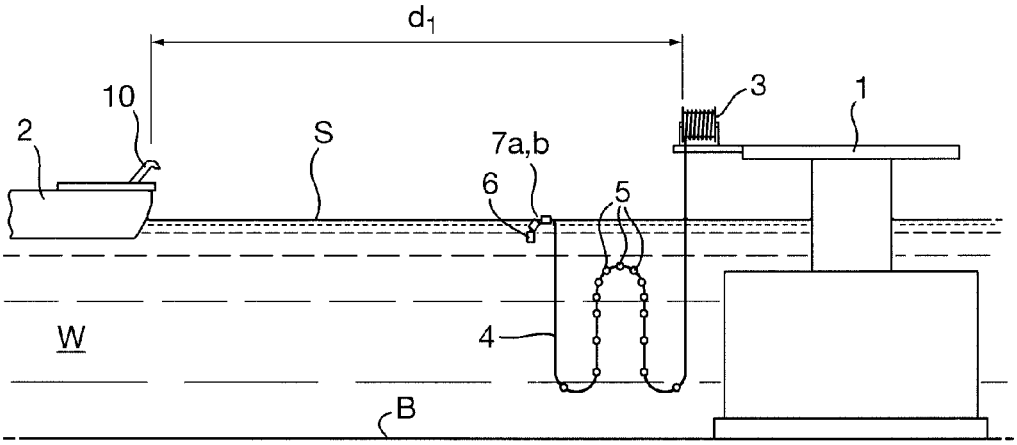
FIG. 4 is a side view similar to that of FIG. 1, but where the loading hose has been disconnected and is floating in the water surface.

In certain situations (e.g. due to an emergency) the hose is instantaneously disconnected from the coupling station 10 on the shuttle tanker (a so-called quick disconnect), i.e. without the aid of the aforementioned lines, etc. In a quick disconnect procedure, the hose free end (i.e. the hose coupler 6) falls freely into the water W. FIG. 4 illustrates how the hose 4 is floating after a quick disconnect, when the hose has attained an equilibrium state in the water. The buoyancy elements 7*a,b* near the hose free end ensures that the free end (and thus the coupler 6) floats in or near the water surface, from where it easily may be retrieved. The free end buoyancy elements 7*a,b* ensure that the hose does not sink down into the water where it could have impacted on flowlines and other equipment associated with the GBS, or on the GBS itself.

Figure 6:
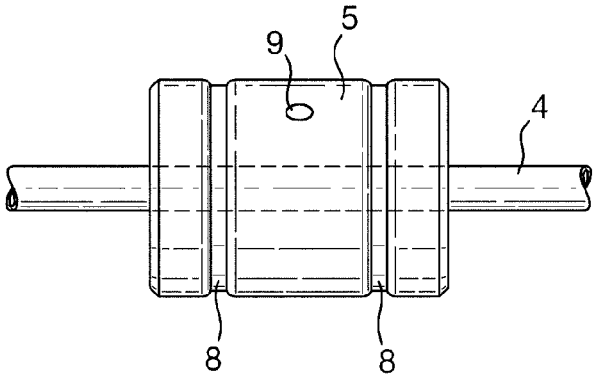
FIG. 6 is a side view of a variant of a buoyancy element which is connected to the loading hose mid section.

FIG. 6 illustrates a variant of the buoyancy element 5, having a cylindrical shape and surrounding a portion of the hose 4.

Figure 5:
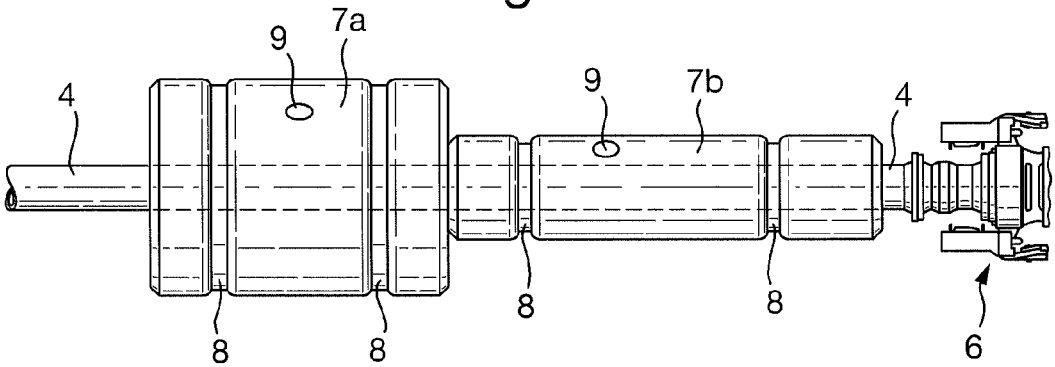
FIG. 5 is a side view of two variants of the buoyancy elements which are connected to the loading hose free end, i.e. near the hose coupling.

FIG. 5 illustrates two variants of buoyancy elements. A first element 7*a* has a cylindrical shape and surrounds a portion of the hose 4. A second element 7*b* has a cylindrical shape and surrounds a portion of the hose 4.

The buoyancy elements 5, 7*a,b* are designed to have a density which is suitable for the applicable situation. For example, a buoyancy element may have a buoyancy of 400 $kg/m^3$. The buoyancy elements are elastic, designed to adapt itself to the reel shape, and to withstand the contact forces when the hose is stored on the reel.

The buoyancy elements comprise internal ballast compartments 9, into which e.g. solid ballast may be inserted in order to adjust the buoyancy, if necessary during first installation. The buoyancy elements comprise two identical parts, which are joined around the hose by a suitable implement, for examples straps (not shown) in suitable recesses 8.

The skilled person will understand that the hose may also be connected to the mid-ship manifold on a tanker, instead of to the bow of the shuttle tanker as described above. In that case, the hose comprises a standard valve connection and separate buoyancy element attached to the hose end.

Although the description of the one or more embodiments refers to a loading hose, the skilled person understands that the present disclosure is equally applicable to pipelines in general, including steel tubular pipelines as well as bonded and non-bonded flexible flowlines fabricated of composite materials.

The invention claimed is:

1. A fluid transfer system, comprising:

a first structure comprising a hydrocarbon production and/or storage facility and a second structure comprising a hydrocarbon transport vessel arranged in water and at a distance apart, and a pipeline configured for connection between the structures, wherein the structures comprise respective coupling and suspension mechanisms for suspending respective ends of the pipeline, the coupling and suspension mechanisms comprising:

a reel disposed on the hydrocarbon production and/or storage facility onto which the pipeline is stored; and a manifold disposed above the surface of the water on a bow of the hydrocarbon transport vessel, and the pipeline comprising:

a plurality of first buoyancy elements disposed in a mid region of the pipeline so that the pipeline forms a "soft W" or "soft catenary" in the water, a net buoyancy of the plurality of first buoyancy elements being such that the mid region remains below the water surface, when the pipeline is unwound from the reel;

a free end with a coupling for direct connection to the manifold; and at least one second buoyancy element in a region of the free end and in the vicinity of the coupling, whereby the free end of the pipeline is configured to float after disconnect of the coupling of the free end from the manifold of the hydrocarbon transport vessel, wherein the plurality of first buoyancy elements:

are each cylindrical in shape;

are arranged around a portion of the pipeline; and are elastic such that each adapts to a shape of the reel when the pipeline is stored without removing the plurality of first buoyancy elements.

2. The fluid transfer system of claim 1, wherein the number of the second buoyancy elements is fewer compared to the number of the plurality of first buoyancy elements.

3. The fluid transfer system of claim 1, wherein the at least one second buoyancy element:

is cylindrical in shape;

is arranged around another portion of the pipeline; and is elastic such that the at least one second buoyancy element adapts to the shape of the reel when the pipeline is stored on the reel without removing the at least one second buoyancy element.

4. The fluid transfer system of claim 1, wherein the at least one second buoyancy element and the plurality of first buoyancy elements comprise a compartment into which a ballast material is inserted.

5. The fluid transfer system of claim 1, wherein the manifold is arranged in a bow region of the hydrocarbon transport vessel.

* * * * *